US008656825B2

(12) United States Patent
Dawson

(10) Patent No.: US 8,656,825 B2
(45) Date of Patent: Feb. 25, 2014

(54) TELESCOPIC COMPOSITE CYLINDER HYDRAULIC HOIST

(76) Inventor: Steven Clare Dawson, Phelpston (CA)

( * ) Notice: Subject to any disclaimer, the term of this patent is extended or adjusted under 35 U.S.C. 154(b) by 909 days.

(21) Appl. No.: 12/794,002

(22) Filed: Jun. 4, 2010

(65) Prior Publication Data

US 2010/0307331 A1 Dec. 9, 2010

Related U.S. Application Data

(60) Provisional application No. 61/184,074, filed on Jun. 4, 2009.

(51) Int. Cl.
*F01B 7/20* (2006.01)
*F01B 15/04* (2006.01)

(52) U.S. Cl.
USPC ..... 92/53; 92/118

(58) Field of Classification Search
USPC ..... 92/52, 53, 118, 161.5
See application file for complete search history.

(56) References Cited

U.S. PATENT DOCUMENTS

| | | | | |
|---|---|---|---|---|
| 3,943,423 | A * | 3/1976 | Hoffman | 320/138 |
| 4,921,732 | A * | 5/1990 | Bounds | 427/325 |
| 6,244,450 | B1 * | 6/2001 | Woodling | 212/349 |
| 6,450,083 | B1 * | 9/2002 | Dawson | 92/53 |
| 6,899,014 | B2 * | 5/2005 | Dawson | 92/52 |
| 2007/0028532 | A1 * | 2/2007 | Douglas et al. | 52/118 |

* cited by examiner

*Primary Examiner* — Michael Leslie
(74) *Attorney, Agent, or Firm* — Miller Thomson LLP; Eugene Gierczak; Eduardo Krupnik

(57) ABSTRACT

The present invention is a telescopic composite cylinder that functions as a hydraulic hoist incorporating multiple cylinders formed of composite materials. The walls of the multiple cylinders may be formed of pultruded composite material, or a combination of composite materials. The cylinders of the hydraulic hoist may incorporate a plurality of piston and sleeve assemblies that are mounted so as to invoke a telescopic relationship between the multiple cylinders. The materials that the cylinders are formed of may create walls having a smooth surface that can eliminate problems facing hoists formed of other materials, for example, such as a honing process, fluid leakage and seal wearing problems. The hoist may be run on diesel fuel drawn from the tank of a vehicle. Additionally, the present invention may be releasably attached to a surface by way of a saddle mounting system.

20 Claims, 3 Drawing Sheets

TELESCOPIC COMPOSITE CYLINDER HYDRAULIC HOIST

This application claims the benefit of U.S. Provisional Patent Application Ser. No. 61/184,074 filed Jun. 4, 2009.

FIELD OF INVENTION

This invention relates in general to the field of hydraulic hoists and in particular to hydraulic hoists formed of composite materials.

BACKGROUND OF THE INVENTION

Heavy duty telescoping hydraulic hoists, such as are commonly used in dump trucks and the like, are typically composed of steel. Steel is a strong, relatively rigid metal which, when formed to a suitable wall thickness, provides the necessary support for the hoist and its load, and operates effectively under the extremely high hydraulic pressures to which such devices are subjected.

Telescopic hydraulic hoists are increasing in popularity in the haulage trucking industry. Competitors entering the market include Custom Hoist, Hyco 3000, Edbro, and Hyva Group. Custom Hoist, Hyco 3000 and Edbro all produce steel hoists. The Hyva Group produces a telescopic hydraulic hoist that is approximately 60% lighter than known prior art hoists.

U.S. Pat. No. 6,899,014 discloses a hydraulic hoist having tube stage walls formed from a heat treated aluminum alloy from one of the series 2000, 6000 or 7000 aluminum alloys. Such alloys retain "memory" properties. Under the force of a pressure spike the alloys undergo a momentary elastic deformation which acts as a shock absorber. The tube wall is expanded to absorb the peak stresses and resist buckling. The hoist disclosed in this patent is lighter than the steel hoists of the prior art, and is also more resistant to corrosion.

SUMMARY OF THE INVENTION

In one aspect, the present disclosure relates to a composite material telescopic multi-cylinder hydraulic hoist, comprising: an outer stage cylinder having one end sealed by a base member and an open end, formed of a composite material; at least one additional cylinder disposed within the open end of the said outer stage cylinder such that there is an overlap between said cylinder stages, said at least one additional cylinder stage being formed of a composite material; a hydraulic fluid port in communication with an interior of the cylinder stages; and at least one seal mounted between cylinder stages, whereby forcing hydraulic fluid into said hydraulic fluid port causes said at least one additional cylinder stage to extend relative to said outer cylinder stage; whereby the cylinder stages have a modulus of elasticity which allows the cylinder stages to expand under the force of a momentary pressure spike, and upon release of the pressure spike, to retract to their original configuration.

In another aspect, the present disclosure relates to a telescopic multi-cylinder hydraulic hoist mountable upon a vehicle having a fuel tank, comprising: an outer stage cylinder having one end sealed by a base member and an open end, formed of a composite material; at least one additional cylinder disposed within the open end of the said outer stage cylinder such that there is an overlap between said cylinder stages, said at least one additional cylinder stage being formed of a composite material; a hydraulic fluid port in communication with an interior of the cylinder stages; and at least one seal mounted between cylinder stages, whereby forcing hydraulic fluid into said hydraulic fluid port causes said at least one additional cylinder stage to extend relative to said outer cylinder stage, the hydraulic fluid being drawn from the fuel tank of the vehicle; whereby the cylinder stages have a modulus of elasticity which allows the cylinder stages to expand under the force of a momentary pressure spike, and upon release of the pressure spike, to retract to their original configuration.

In yet another aspect, the present disclosure relates to a telescopic multi-cylinder hydraulic hoist releasably mounted on a vehicle, comprising: an outer stage cylinder having one end sealed by a base member and an open end, formed of a composite material; at least one additional cylinder disposed within the open end of the said outer stage cylinder such that there is an overlap between said cylinder stages, said at least one additional cylinder stage being formed of a composite material; a hydraulic fluid port in communication with an interior of the cylinder stages; at least one seal mounted between cylinder stages, whereby forcing hydraulic fluid into said hydraulic fluid port causes said at least one additional cylinder stage to extend relative to said outer cylinder stage, the hydraulic fluid being drawn from the fuel tank of the vehicle; and a saddle mounting system to releasably attach the telescopic multi-cylinder hydraulic hoist to the vehicle; whereby the cylinder stages have a modulus of elasticity which allows the cylinder stages to expand under the force of a momentary pressure spike, and upon release of the pressure spike, to retract to their original configuration; and whereby the saddle mounting system functions so that if the vehicle tips-over the saddle mounting system breaks away from the composite cylinder and the composite cylinder remains unstressed.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
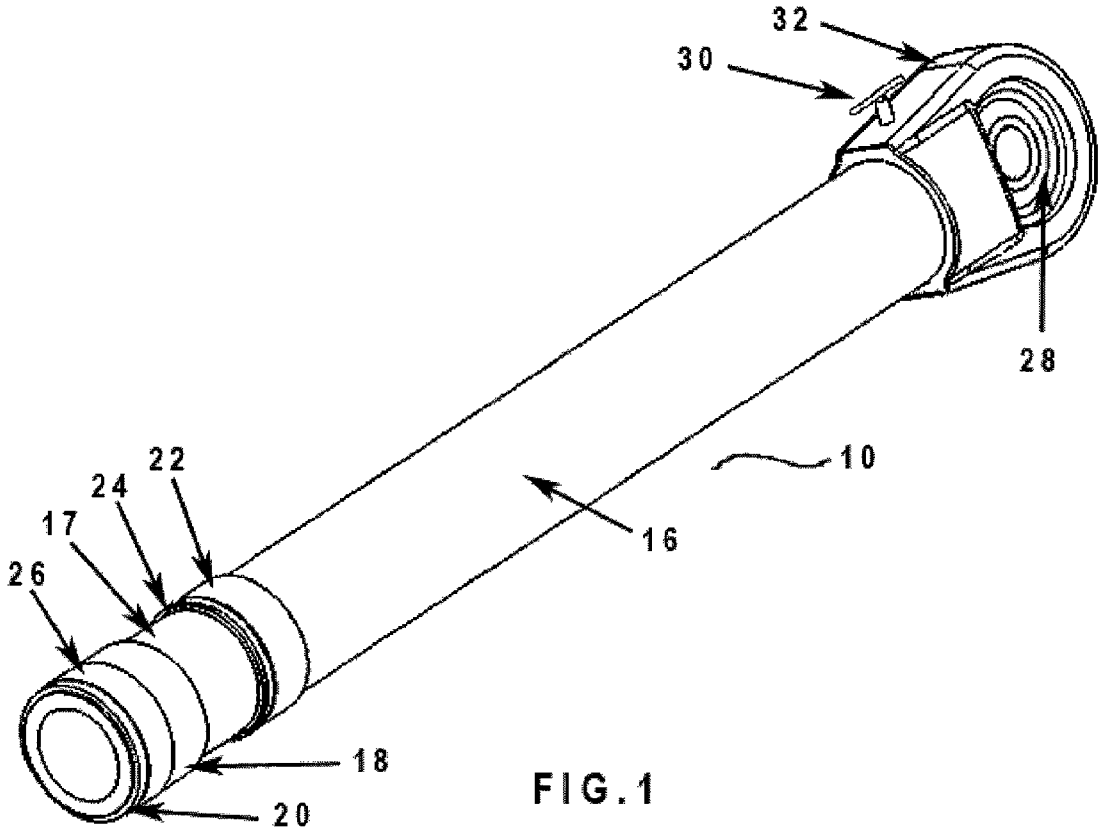
FIG. 1 is a side-view of the present invention.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

The present invention is a telescopic composite cylinder that functions as a hydraulic hoist incorporating multiple cylinders formed of composite materials. The walls of the multiple cylinders may be formed of pultruded composite material, or a combination of composite materials. The cylinders of the hydraulic hoist may incorporate a plurality of piston and sleeve assemblies that are mounted so as to invoke a telescopic relationship between the multiple cylinders. The materials that the cylinders are formed of may create walls having a smooth surface that can eliminate problems facing hoists formed of other materials, for example, such as a honing process, fluid leakage and seal wearing problems. The hoist may be run on diesel fuel drawn from the tank of a vehicle, such as, for example, the vehicle that the hoist is transported upon. Running the hoist on diesel fuel may offer multiple means of decreasing the overall weight of the invention, such as, for example, decreasing the weight of the hoist load by eliminating the need for a second tank. Additionally, the present invention may be releasably attached to a surface by way of a saddle mounting system. The saddle mounting system functions so that should the composite cylinder be releasably attached to a trailer that tips-over the bolts of the saddle mounting system may break away from the composite cylinder before the composite cylinder can be stressed. In this manner damage to the composite cylinder, and any environment damage possibly caused by leakage of hydraulic fluid, may be averted.

The present invention is constructed and operates in a manner similar to that shown and described in the inventor's U.S. Pat. No. 6,899,014 issued to the inventor May 31, 2005, which is incorporated herein by reference. A skilled reader will recognize that the present invention may be operable to undertake any task that a heavy duty telescoping hydraulic hoist may achieve, such as, for example use in a dump truck or any other high load-bearing application. A skilled reader will further recognize that the present invention is not restricted to any particular embodiment illustrated in the drawings.

In general, the present invention is a composite cylinder formed of multiple cylinders that may operate in a telescopic manner. The multiple cylinders may nest inside one another when the composite cylinder is collapsed. The multiple cylinders may be positioned sequentially when the composite cylinder is extended. The multiple cylinders that collectively comprise the composite cylinder, may each be a stage, a moving stage, or a tube. A skilled reader will recognize the various terms that may be utilized to describe the cylinders of embodiments of the present invention. The cylinders may be shaped to have a diameter that decreases from one end to another, moreover, the diameter of each cylinder may decrease sequentially in relation to the preceding cylinder. Pressure exerted within the cylinders, such as by hydraulic fluid, may cause the composite cylinder to alter between a collapsed and an extended state. Additionally the composite cylinder may be utilized to extend to positions that are less than a fully extended state.

The present invention represents benefits over the prior art. For example, hoists formed of steel are very heavy. This heaviness can reduce the efficiency of vehicles such as dump trucks that have to carry the hoist when transporting a load. Moreover, steel corrodes at a fairly high rate, which reduces the life of the rings and seals that are used to contain the hydraulic fluid and to ensure that the stages move freely relative to one another, and reduces the durability of the hoist components in general. It is therefore advantageous to construct a telescoping hydraulic hoist from a non-corrosive material which is lighter than steel, such as the hydraulic hoist formed of composite material of the present invention. This can considerably reduce the weight of the hoist and significantly extend the useful life of many of its components.

The present invention also represents a benefit over hydraulic hoists formed of pure aluminum. It has been found that pure aluminum is too soft and weak to support the type of load that such hoists are designed to lift. The hydraulic hoist formed of composite material of the present invention is stronger than hoists formed of aluminum.

The present invention also offers benefits over hoists formed of aluminum alloys. Such aluminum alloys may include alloys composed of at least 75% aluminum and containing one or more other metallic elements such as copper, manganese, magnesium, silicon, zinc, and/or lithium, and can be considerably stronger than pure aluminum. The additional metallic elements are known to substantially improve many mechanical characteristics of the alloy over pure aluminum, including its strength, particularly in the case of heat treatable aluminum alloys which can be processed to have strength comparable to that of steel. However, the modulus of elasticity of aluminum is typically around one-third of the modulus of elasticity of steel. It is commonly believed that even heat treated aluminum alloys would deform under stresses which would not affect steel, causing the hoist to buckle under peak stresses which can be encountered during normal operation, and especially if the hoist malfunctions or if it is operated in an abusive or careless fashion.

In the heavy duty hydraulic hoist industry buckling is a major concern, and the low modulus of elasticity of aluminum alloys has resulted in the universal perception that such alloys are unsuitable for use in heavy-duty hydraulic cylinders. This perception includes low buckling point, and an inability to withstand the severe shocks, stresses and spikes in pressure that such hydraulic cylinders are subject to especially when used for dump trucks and other similar high stress applications. It is accordingly conventionally believed that such materials are unsuitable for use in heavy duty hydraulic hoist applications. As a result there are no heavy duty aluminum hydraulic cylinders available in the market, although aluminum is in common use for light duty applications.

The present invention offers a benefit over prior art hoists formed of aluminum alloys in that it offers a lighter hoist that has sufficient strength to undertake heavy duty applications. In certain industries (such as the trucking industry), any significant reduction in weight is extremely valuable because it increases available payload, and reduces fuel consumption and wear and tear on the vehicle. Thus the weight saving of the present invention over prior art steel hoists that are currently the standard can be substantial, potentially running into hundreds of tons. In addition, the present invention may offer significant environmental benefits because it may be feasible to employ a water-based hydraulic medium that is environmentally friendly and less expensive than oil.

In one embodiment of the present invention, as shown in FIG. 1, the hoist 10 may be formed of two or more cylinders 16 and 17. Such cylinders may be formed in a manner whereby the cylinders are of graduating sizes, so that one cylinder may be fit within another cylinder. For example, as shown in FIG. 1, an inner cylinder 17 may fit within an outer cylinder 16. In other embodiments of the present invention one or more additional cylinders, being progressively smaller than cylinder 17, may be fit within cylinder 17.

Figure 2:
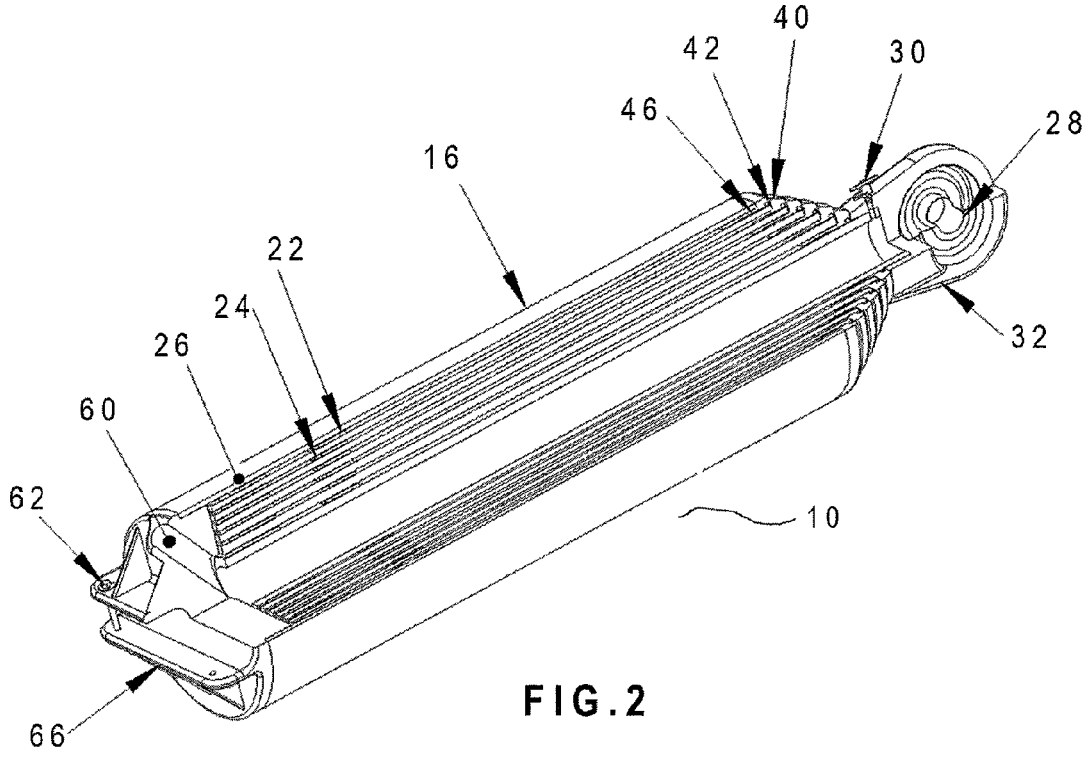
FIG. 2 is a partial sectional-view of the present invention.

In one embodiment of the present invention, as shown in FIG. 2, multiple cylinders may nest within each other and fit together in a slideable manner whereby they are extendable in a telescopic manner. The smallest cylinder may be the innermost cylinder and the largest cylinder may be the outermost cylinder 16. Other than size each cylinder, other than the outermost cylinder, may be similar to the other cylinders in that each may have a limiting band 22, an upper bearing 46 and a lower bearing 26 with a seal 24. Cylinders may further incorporate a wiper 42 and a gland nut 40 applied to hold a cylinder in position when said cylinder is not extended. An inner cylinder may be slid so as to protrude beyond the limits of an outer cylinder, may be slid so as to fit wholly within the outer cylinder, or may be slid to any intermediate position that causes a portion of the inner cylinder to protrude from an outer cylinder.

As shown in FIG. 2, a limiting band 22 may be positioned at the end of the cylinder, being the end from which an additional cylinder may protrude. A limiting band may have a seal 24 positioned thereupon that seals the space between a cylinder 16 and the other cylinder 17 that protrudes therefrom. This seal may keep hydraulic fluids, utilized to cause the cylinder hoist to function, contained in the space between the cylinders. The seal therefore keeps the hydraulic fluid from leeching into the environment where it may cause contamination.

As shown in FIG. 1, a retaining band 20 may be positioned at the end of the last of the nesting cylinders that does not have another cylinder fit therewithin. The retaining band may be coupled with an upper retaining band 18 and a lower bearing 26.

In one embodiment of the present invention, a mount may be attached to the innermost cylinder, being the smallest cylinder. The mount 32 may be utilized to attach the hoist 10 to a surface, such as a surface of a vehicle, for example a truckbed. The mount 32 may include a bearing 28, to permit the hoist 10 to be rotatable while attached to the surface. A valve 30 may also be attached to the mount whereby air, hydraulic fluid or any other substance trapped within the hoist or the mount may be released. A skilled reader will recognize that a mount may be attached to the composite cylinder in many ways and may be attached to cylinders other than the innermost cylinder, such as, for example the outermost cylinder.

The present invention may be formed of composite material. Such a material may diminish fatigue, as is experienced by some metals. Composite material may also be resistant to rust and pitting. A skilled reader will recognize that a variety of composite materials that may be utilized to form the present invention. For example, one such composite material that may be utilized is carbon fiber. Carbon fiber is generally lighter than aluminum and stronger than steel on a pound for pound basis. Additionally, carbon fiber may be molded into complex shapes and sizes. Carbon fiber may also be "laid-up" with more or less material wherever necessary. Utilizing carbon fiber to form the cylinders and other pieces of the present invention may permit the creation of pieces of the hoist that include particular specifications, for example, such as oversized diameters, unique shapes and exaggerated tapers.

The present invention may be formed of a variety of composite materials, or a collection thereof, including: polymeric material; synthetic resins, such as polyethylene, polypropylene, polybutene; fibers; cords; molded cylinders; protrusion cylinders; stiff organic or inorganic fibers, such as bamboo or silk; and carbon fibers such as Kevlar, an aromatic polyamide. A skilled reader will recognize that other materials may also be utilized to form the present invention.

Any cylinder or other piece of the present invention formed from composite material may be able to withstand high temperatures and pressures. In particular, pressures may be withstood through elasticity of the material whereby it may absorb pressure and pressure will not cause the material to lose its shape, as it retains that shape as "memory" and will return to the original shape upon the cessation of pressure. The modulus of elasticity of a material is a measure of a stress applied to the material divided by strain, within the elastic range of the material. The strain is the ratio of the amount of deformation caused by the stress to the initial length of the material. Therefore, a material which stretches more under a given stress has a lower modulus of elasticity. The present invention being formed of composite material may not require an increase in the thickness of the tube stage walls over the thickness of a counterpart formed of another material, such as steel or aluminum, proportionate to the difference in the modulus of elasticity. The wall thickness may be governed by the theoretical value of deflection. For example, wall thickness may be determined to achieve an approximate maximum deflection of 0.500 inch under ten metric tons load applied in the center of the tube of the composite cylinder. A skilled reader will recognize that other deflections and loads may be applied to determine the wall thicknesses applied in the present invention. The present invention being formed of composite material may additionally project high tensile and yield strengths.

The composite material forming the cylinders may be pultruded or molded. Pultruded cylinders in particular may have smooth surfaces. Pultrusion is a continuous process of manufacturing of composite materials involving at least the step of reinforced fibers being pulled through a resin. Smooth surfaces enhance the extension and collapsing of the cylinders by decreasing the incident of friction between the surfaces of the cylinders as they move against each other. This may have the effect of decreasing the pressure required to extend the cylinders.

Cylinders formed from composite material may be resistant to pitting. When sand or other matter comes in contact with some metals, such as, for example aluminum or steel, the abrasion created by the contact between the metal and the matter can cause pitting of the metal. To protect metals prone to pitting the metal may be chrome plated, however this can be an expensive undertaking. Composite material offers a benefit over other materials in that it is resistant to pitting and therefore retains a smooth surface in the face of contact with abrasive materials. The smooth surface of the composite material may aid the smooth operation of the composite cylinder particularly as it operates in a telescopic manner and its cylinders extend and collapse in relation to one another.

In one embodiment of the present invention, the lower mount of the cylinders may consist of a saddle mounting system. Such a mounting system offers benefits over known prior art mounting means.

Prior art mounting means for cylinders generally involve a pinned hinge system, similar to the hinge of a door. In a pinned hinge system, a lower mount is attached to a trailer bed. A cylinder is positioned over the lower mount. A mount pin passes through mount holes of the lower mount, as well as through a mounting hole, or pipe formed, at the base of a steel cylinder. The effect of the pinned hinge system is that the cylinder is affixed to the trailer unit in a manner whereby, in the situation that the trailer tips-over, as the trailer bed falls sideways, it will put stress on the lower mount. This stress may cause the cylinder to fail and result in the release of the toxic hydraulic fluids into the environment.

Figure 3:
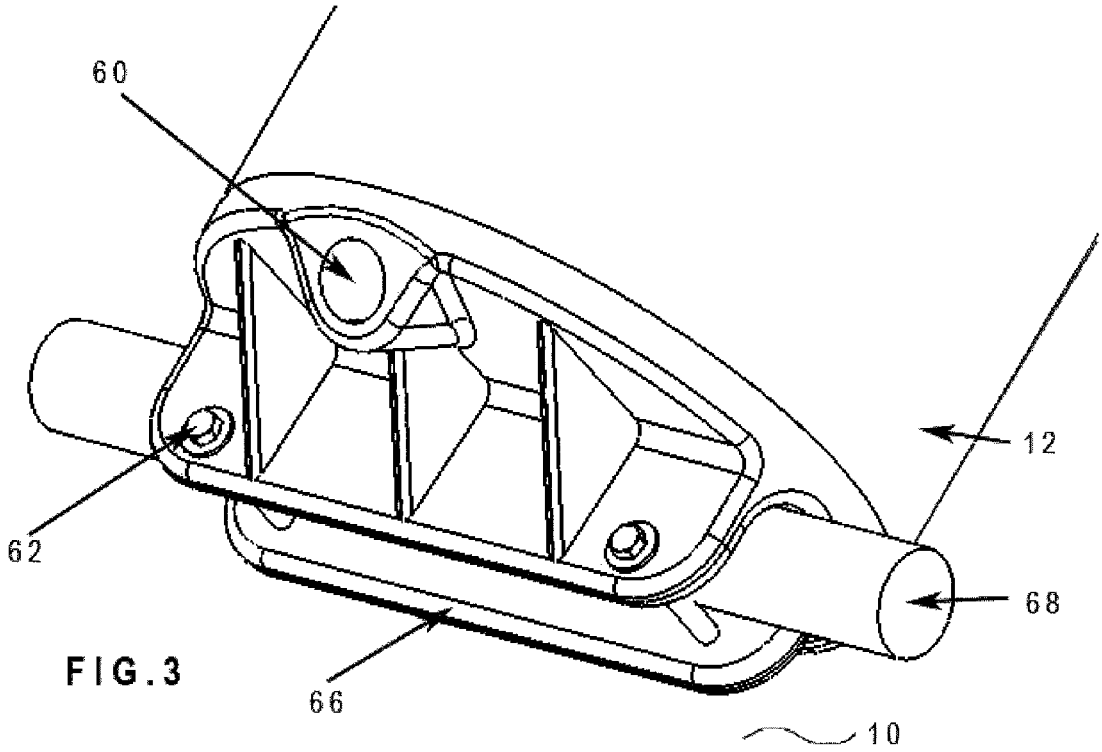
FIG. 3 is a perspective-view of the saddle mounting system of the present invention.

The saddle mounting system of the present invention, as shown in FIG. 3, may incorporate a saddle lower mount 66 that is shaped like a saddle, having an inverted-U or inverted-cup shape. The composite cylinder may be positioned to connect to the outermost cylinder in a manner whereby the saddle shaped portion of the saddle lower mount points away from the lower end of the outermost cylinder. A lower mount pivot bar 68 may be positioned within the saddle shaped portion of the saddle lower mount. The lower mount pivot bar may be releasably fixed within the saddle portion by one or more retaining bolts 62. The one or more retaining bolts may be fitted through holes in the lower portion of the saddle portion, so that the retaining bolts are positioned below the lower mount pivot bar. The pivot bar may be clamped to a surface, such as, for example a trailer bed, by a variety of clamping means. A skilled reader will recognize that many clamping means as well as other attachment means may be applied to releasably attach the composite cylinder to a surface. Should the composite cylinder be releasably attached to a trailer, in the case that the trailer tips-over the bolts may break away from the composite cylinder before the composite cylinder can be stressed. In this manner damage to the composite cylinder may be averted. Additionally, hydraulic fluid may be prevented from leaking into the environment.

One embodiment of the present invention may be a six-stage composite cylinder. Such a cylinder may incorporate a closed volume of approximately 15 gallons and an open volume of approximately 73 gallons. The closed length of the cylinder may be approximately 70 inches, whereas the stroke may be approximately 260 inches. The overall weight of the cylinder may be approximately 355 pounds. A skilled reader will recognize that other embodiments of the present invention may be formed having varying closed and open volumes, closed lengths, strokes and overall weights. The embodiment described herein is provided solely to provide one example of the present invention.

The present invention may be attachable to a variety of surfaces, including surfaces of a vehicle. A variety of attachment means may be employed for the purpose of attaching the present invention to a surface.

In one embodiment of the present invention, multiple cylinders and a base may comprise the composite cylinder, such as, for example, such as six cylinders and a base. Each cylinder may be formed to have a shape that increases in diameter from top to bottom. Moreover, cylinders may be formed to be successively sized so that multiple cylinders may fit within other cylinders. For example, in a collapsed state a composite cylinder incorporating six cylinders may be positioned so that the a sixth cylinder fits within a fifth cylinder, the fifth cylinder fits within a fourth cylinder, the fourth cylinder fits within a third cylinder, and so on. The cylinders may be extended relative to each other, in a telescopic manner, whereby the extended length of the composite cylinder will range from the total length achieved when all of the cylinders are extended, to the length of the outer cylinder, which is virtually the full length of the composite cylinder when all of the cylinder are collapsed. In various levels of extension the composite cylinder may be able to lift an object, such as, for example a truck trailer, for a specific purpose, such as, for example unloading.

In one embodiment of the present invention extension of the composite cylinder may occur due to hydraulic pressure caused by the injection of a hydraulic fluid inside the composite cylinder. The hydraulic fluid may be of several types, including kerosene, water/antifreeze mixture, or diesel fuel. The application of any hydraulic fluid that is not the same as the fluid in the fuel tank of the vehicle may require that an additional hydraulic fluid tank be attached to the vehicle and the composite cylinder. Utilizing diesel fuel has the added advantage that such fuel may be obtained directly from the fuel tank of the vehicle that the composite cylinder is attached to. Utilizing diesel fuel from the tank of the vehicle negates the need for a separate tank and consequently reduces the overall weight of the composite cylinder system.

In one embodiment of the present invention, hydraulic fluids may be injected into the cylinder via a threaded port 60. This threaded inlet port may be located at the saddle lower mount positioned at the lower end of the composite cylinder. In an embodiment that draws fuel from the truck fuel tank, a hydrostatic pump may cause fluid to be pumped directly from the main fuel tank of the truck. The fluid may be pumped directly so as to cause the lower control for the cylinder to operate to raise the cylinder. In another embodiment, a fluid tank may be attached to the truck and hydraulic fluid may be pumped by a hydrostatic pump from the fluid tank in a manner so as to cause the lower control for the composite cylinder to operate to raise the cylinders.

In another embodiment of the present invention, the composite cylinder may operate by way of double-acting cylinders. Hydraulic fluid may, be injected into the cylinder by way of a threaded port to cause the composite cylinder to operate to lower the cylinder. Therefore, the injection of the hydraulic fluid may exert pressure upon cylinders to cause them to collapse.

In yet another embodiment of the present invention, the composite cylinder may function as a ram or a hoist.

The flow of hydraulic fluid to and from the cylinders may cause the cylinders to operate. Pressurized fluid may enter a cylinder via the inlet port. The fluid may expand within the cylinder and thereby push against the piston seals. This may cause the cylinders to raise gradually in stages. As a greater volume of fluid may utilize less pressure per lifting ton, the largest composite cylinder may be raised first, and the next largest cylinder may be raised next. This sequence may proceed in succession, until the last and smallest cylinder is raised. Lowering, or collapsing, of the cylinders may proceed from the opposite operation. Therefore, when the composite cylinder is collapsed, the smallest section of the cylinder may be lowered first.

The present invention may offer several advantages over the prior art. For example, the present invention may provide the advantage of decreased overall weight as compared to the prior art.

Decreased overall weight may occur for a variety of reasons. First, a composite cylinder, formed of composite materials, may weigh less, for example, such as approximately 60% less, than known steel hoists. Second, should the composite cylinder utilize the fuel of the vehicle the composite cylinder is positioned upon as the hydraulic fuel, and such fuel is accessed from the tank of the vehicle, then there will be no need to include a separate tank for hydraulic fluid, as is required in known prior art. The hydraulic fluid tank adds weight to the composite cylinder system that is not required in the present invention. The hydraulic fluid, tank and brackets may add approximately 500 pounds to the vehicle's empty weight. Thirdly, by using the vehicle fuel as the hydraulic fluid, the overall weight of the vehicle load will be decreased by a reduction of fuel in the tank on the return trip.

Weight savings may have an effect upon the haulage of the vehicle and the weight of the return trip. A lower weight while the vehicle is being driven can produce fuel savings as a lighter vehicle will expend less fuel. It is estimated that an operator may be able to carry a load that is approximately 3% greater overall and save on weight by approximately 1,100 pounds on the empty return trip. The result is that the haulage may increase for the entire trip and fuel savings may be experienced on the return trip. Additionally, running the composite cylinder on the diesel fuel from the vehicle's tank has the result that there is no reason to change the hydraulic fluid. This has the result of reduced costs in that the cost of changing the hydraulic fluid is avoided.

Another benefit of the present invention is that use of fuel from the tank of the vehicle as hydraulic fluid may negate the need for transferring a potentially environmentally hazardous fluid as the hydraulic fluid in a tank attached to the vehicle. In the case of an accident, or upon deterioration of the tank, the hydraulic fluid may leak into the environment. By utilizing the fuel in the tank of the vehicle the potential environmental hazard caused by leakage is avoided altogether.

Yet another benefit of the present invention is that the composite material used to form the composite cylinder is not subject to either metal fatigue, rust or pitting. Both fatigue and rust are problems that affect known prior art hoists. In particular, steel hoists become brittle and breakage may occur. The cost of repairing breakage, cleaning up rust, or replacing parts due to fatigue can be high.

Another benefit of the present invention is that the method of pultruding the composite cylinders creates a smooth surface that avoids problems that affect other known prior art. For example, pultruded composite cylinders eliminate the honing process, fluid leakage and seal wearing problems. Composite cylinders may be formed from either pultruded or molded parts. Pultruding and molding the parts can involve fewer processes and less labour overall to create each composite cylinder unit, as compared to the creation of known prior art hoists. Additionally the quality control for each unit may be increased. The result is the production of composite cylinders that offer improved reliability over the known prior art hoists.

Still another benefit of the present invention is that the lower mount design permits "drop-in" installation on the vehicle. Prior art applies a side load mount which can cause stress in hydraulic cylinders. Such stress can further cause seals to wear prematurely. Replacing one set of seals in a steel hoist can cost a substantial amount, such as, for example approximately $1000.00 for parts and labour fees. Avoiding premature seal wearing offers costs savings as well as avoiding maintenance requirements which may force a cylinder to be unworkable for a period of time.

It will be appreciated by those skilled in the art that other variations of the embodiments described herein may also be practiced without departing from the scope of the invention. Other modifications are therefore possible. For example, the composite cylinder may be utilized to lift a variety of objects that need to be lifted at a specific point.

The invention claimed is:

1. A composite material telescopic multi-cylinder hydraulic hoist said telescopic multi-cylinder hydraulic hoist being formed of composite material and being operable to undertake heavy duty applications, comprising:

(a) an outer stage cylinder having one end sealed by a base member and an open end, formed of the composite material;

(b) at least one additional cylinder disposed within the open end of the said outer stage cylinder such that there is an overlap between said cylinder stages, said at least one additional cylinder stage being formed of the composite material;

(c) a hydraulic fluid port in communication with an interior of the cylinder stages; and (d) at least one seal mounted between cylinder stages, whereby forcing hydraulic fluid into said hydraulic fluid port causes said at least one additional cylinder stage to extend relative to said outer cylinder stage;

whereby the cylinder stages have a modulus of elasticity which allows the cylinder stages to expand under the force of a momentary pressure spike, and upon release of the pressure spike, to retract to their original configuration.

2. The composite material telescopic multi-cylinder hydraulic hoist of claim 1, wherein the outer stage cylinder and the at least one additional cylinder incorporate a plurality of piston and sleeve assemblies.

3. The composite material telescopic multi-cylinder hydraulic hoist of claim 1, wherein a telescopic relationship is invoked between the outer stage cylinder and the at least one additional cylinder and the outer stage cylinder and the at least one additional cylinder form a six-stage composite cylinder.

4. The composite material telescopic multi-cylinder hydraulic hoist of claim 1, wherein the composite material is one or more of: polymeric material; synthetic resins; fibers; cords; molded cylinders; protrusion cylinders; stiff organic or inorganic fibers; or carbon fibers.

5. The composite material telescopic multi-cylinder hydraulic hoist of claim 4, wherein the composite material is one or more of the following:

(a) the synthetic resins that are any of the following: polyethylene, polypropylene, and polybutene;

(b) the stiff organic or inorganic fibers that are any of the following: bamboo and silk; or (c) the carbon fibers that are any of the following: Kevlar, and aromatic polyamide.

6. The composite material telescopic multi-cylinder hydraulic hoist of claim 1, wherein the composite material is carbon fiber.

7. The composite material telescopic multi-cylinder hydraulic hoist of claim 1, wherein the composite material is smooth on its surface whereby minimal friction occurs between the outer stage cylinder and the at least one additional cylinder upon extension or collapse of said outer stage cylinder and the at least one additional cylinder, and whereby the requisite pressure to extend the composite material telescopic multi-cylinder hydraulic hoist is minimized.

8. The composite material telescopic multi-cylinder hydraulic hoist of claim 7, wherein the smooth composite material averts one or more of the following: a honing process; hydraulic fluid leakage; or wearing of the at least one seal.

9. The composite material telescopic multi-cylinder hydraulic hoist of claim 1, wherein the composite material is resistant to pitting.

10. The composite material telescopic multi-cylinder hydraulic hoist of claim 1, wherein the composite material is pultruded.

11. The composite material telescopic multi-cylinder hydraulic hoist of claim 1, wherein the outer stage cylinder and the at least one additional cylinder extend or collapse in a manner of double-acting cylinders.

12. The composite material telescopic multi-cylinder hydraulic hoist of claim 1, wherein the hoist is lightweight and sufficiently durable to perform heavy duty applications.

13. A telescopic multi-cylinder hydraulic hoist mountable upon a vehicle having a fuel tank, said telescopic multi-cylinder hydraulic hoist being formed of composite material and operable to undertake heavy duty applications, comprising:

(a) an outer stage cylinder having one end sealed by a base member and an open end, formed of the composite material;

(b) at least one additional cylinder disposed within the open end of the said outer stage cylinder such that there is an overlap between said cylinder stages, said at least one additional cylinder stage being formed of the composite material;

(c) a hydraulic fluid port in communication with an interior of the cylinder stages; and (d) at least one seal mounted between cylinder stages, whereby forcing hydraulic fluid into said hydraulic fluid port causes said at least one additional cylinder stage to extend relative to said outer cylinder stage, the hydraulic fluid being drawn from the fuel tank of the vehicle;

whereby the cylinder stages have a modulus of elasticity which allows the cylinder stages to expand under the force of a momentary pressure spike, and upon release of the pressure spike, to retract to their original configuration.

14. The telescopic multi-cylinder hydraulic hoist mountable upon a vehicle of claim 13, wherein the hydraulic fluid is drawn from the fuel tank of the vehicle by a hydrostatic pump and the drawing of hydraulic fluid decreases the overall combined weight of the hoist and hydraulic fluid when said hoist is mounted upon the vehicle.

15. The telescopic multi-cylinder hydraulic hoist mountable upon a vehicle of claim 13, wherein the hydraulic fluid is diesel fuel.

16. A telescopic multi-cylinder hydraulic hoist releasably mounted on a vehicle, said telescopic multi-cylinder hydraulic hoist being formed of composite material and operable to undertake heavy duty applications, comprising:

(a) an outer stage cylinder having one end sealed by a base member and an open end, formed of the composite material;

(b) at least one additional cylinder disposed within the open end of the said outer stage cylinder such that there is an overlap between said cylinder stages, said at least one additional cylinder stage being formed of the composite material;

(c) a hydraulic fluid port in communication with an interior of the cylinder stages;

(d) at least one seal mounted between cylinder stages, whereby forcing hydraulic fluid into said hydraulic fluid port causes said at least one additional cylinder stage to extend relative to said outer cylinder stage, the hydraulic fluid being drawn from the fuel tank of the vehicle; and (e) a saddle mounting system to releasably attach the telescopic multi-cylinder hydraulic hoist to the vehicle;

whereby the cylinder stages have a modulus of elasticity which allows the cylinder stages to expand under the force of a momentary pressure spike, and upon release of the pressure spike, to retract to their original configuration; and whereby the saddle mounting system functions so that if the vehicle tips-over the saddle mounting system breaks away from the composite cylinder and the composite cylinder remains unstressed.

17. The telescopic multi-cylinder hydraulic hoist releasably mountable upon a vehicle of claim 16, wherein the hoist is formed of a composite material.

18. The telescopic multi-cylinder hydraulic hoist releasably mountable upon a vehicle of claim 17, wherein the composite material is at least one of the following;

(a) resistant to fatigue; or (b) of high tensile and yield strengths.

19. The telescopic multi-cylinder hydraulic hoist releasably mountable upon a vehicle of claim 16, wherein the saddle mounting system attaches to the outer stage cylinder.

20. The telescopic multi-cylinder hydraulic hoist releasably mountable upon a vehicle of claim 16, wherein the saddle mounting system comprises:

(a) a saddle lower mount having a saddle shape that points away from the lower end of the outer stage cylinder when it is releasably attached to the hoist; and (b) a lower mount pivot bar positioned within the saddle shape of the saddle lower mount, said lower mount pivot bar being releasably fixed within the saddle shape by one or more retaining bolts at a first end and attachable to a surface of the vehicle at a second end.

* * * * *